US006701855B2

(12) United States Patent
Barba

(10) Patent No.: US 6,701,855 B2
(45) Date of Patent: Mar. 9, 2004

(54) PROCESS FOR THE PYROLYSIS OF MEDICAL WASTE AND OTHER WASTE MATERIALS

(75) Inventor: Peter David Barba, Lincoln, RI (US)

(73) Assignee: Global Environmental Technologies, LLC, Honolulu, HI (US)

( * ) Notice: Subject to any disclaimer, the term of this patent is extended or adjusted under 35 U.S.C. 154(b) by 0 days.

(21) Appl. No.: 10/452,326

(22) Filed: Jun. 2, 2003

(65) Prior Publication Data

US 2003/0221597 A1 Dec. 4, 2003

Related U.S. Application Data

(60) Provisional application No. 60/385,772, filed on Jun. 3, 2002.

(51) Int. Cl.[7] ..... F23B 5/00; F23C 9/00; F23G 7/06

(52) U.S. Cl. ..... 110/342; 110/230; 110/210; 110/242

(58) Field of Search ..... 110/242, 342, 110/238, 210, 211, 212, 204, 229, 230; 48/197 R, 76; 202/96, 105, 109, 117

(56) References Cited

U.S. PATENT DOCUMENTS

| | | | | | |
|---|---|---|---|---|---|
| 3,885,906 | A | * | 5/1975 | Shurygin et al. | 431/173 |
| 4,412,889 | A | * | 11/1983 | Oeck | 202/117 |
| 4,474,121 | A | * | 10/1984 | Lewis | 110/346 |
| 4,517,906 | A | * | 5/1985 | Lewis et al. | 110/346 |
| 4,603,644 | A | | 8/1986 | Brookes | 110/194 |
| 4,648,328 | A | | 3/1987 | Keough | 110/229 |
| 4,759,300 | A | * | 7/1988 | Hansen et al. | 110/229 |
| 4,840,129 | A | | 6/1989 | Jelinek | 110/229 |
| 4,863,702 | A | * | 9/1989 | Galloway et al. | 422/189 |
| 4,913,069 | A | * | 4/1990 | Schultz et al. | 110/346 |
| 4,917,023 | A | * | 4/1990 | Jones | 110/230 |
| 4,931,171 | A | | 6/1990 | Piotter | 208/409 |
| 4,934,283 | A | * | 6/1990 | Kydd | 110/246 |
| 5,040,972 | A | * | 8/1991 | Kleinhenz et al. | 432/72 |
| 5,271,827 | A | | 12/1993 | Woebcke | 208/132 |
| 5,292,695 | A | * | 3/1994 | Galloway | 502/53 |
| 5,387,321 | A | | 2/1995 | Holland | 202/99 |
| 5,409,675 | A | | 4/1995 | Narayanan | 422/197 |
| 5,421,275 | A | * | 6/1995 | Elliott et al. | 110/346 |
| 5,449,438 | A | | 9/1995 | Jagau et al. | 201/10 |
| 5,470,544 | A | * | 11/1995 | Galloway | 422/213 |
| 5,579,704 | A | * | 12/1996 | Mansur | 110/185 |
| 5,611,289 | A | | 3/1997 | Brookes | 110/194 |
| 5,868,085 | A | | 2/1999 | Hansen et al. | 110/346 |
| 6,178,899 | B1 | * | 1/2001 | Kaneko et al. | 110/346 |
| 6,305,302 | B2 | | 10/2001 | Kleiss | 110/210 |
| 6,551,563 | B1 | | 4/2003 | Kado et al. | 422/186.21 |
| 6,552,295 | B2 | * | 4/2003 | Markunas et al. | 219/121.36 |

* cited by examiner

*Primary Examiner*—Kenneth B. Rinehart
(74) *Attorney, Agent, or Firm*—Barlow, Josephs & Holmes, Ltd.

(57) ABSTRACT

A process for the pyrolysis of waste materials, particularly medical waste, is provided. In the pyrolysis process, waste material is placed in a sealed container. The sealed container is placed in a load chamber and the waste material is subjected to pyrolysis. The process generates pyrolysis gases containing volatile organic compounds which are fed to an oxidation chamber containing tangential and radial air inlet ports. The pyrolysis gases are combusted and hot gases are produced in the oxidation chamber. In the operation, at least a portion of the generated heat and hot gases is fed to the load chamber which holds the pyrolysis container.

21 Claims, 5 Drawing Sheets

PROCESS FOR THE PYROLYSIS OF MEDICAL WASTE AND OTHER WASTE MATERIALS

CROSS-REFERENCE TO RELATED APPLICATIONS

This application claims the benefit of U.S. Provisional Application No. 60/385,772 having a filing date of Jun. 3, 2002, the contents of which are hereby incorporated by reference.

BACKGROUND OF THE INVENTION

The present invention generally relates to a process for the pyrolysis of waste materials particularly medical waste. More particularly, the invention relates to a pyrolysis process, wherein the waste material is placed in a sealed container. The sealed container is inserted in a load chamber and the waste material is subjected to the process of pyrolysis.

In recent years, government agencies, industries, and other organizations have had to address various problems relating to the handling and processing of organic waste materials including chemical and biological products. The disposal of medical waste is a particularly difficult problem, because of the presence of infectious bacteria, viruses, and other pathogens in the waste. It has been found that heating such organic waste materials to extremely high temperatures causes the components to thermally decompose. The heat energy converts the chemical components of the waste material (primarily carbon, hydrogen, and trace elements) to gases. A pyrolysis process is commonly used to thermally decompose and chemically transform the waste materials.

The term, "pyrolysis", can have different meanings depending on its context. For example, "pyrolysis" is defined as the "transformation of a compound into one or more substances by heat alone, i.e., without oxidation." (*Hawley's Condensed Chemical Dictionary*, 13$^{th}$ Ed. (1997) .) In the Code of Federal Regulations (CFR) setting forth standards for the performance of hospital/medical/infectious waste incinerators, "pyrolysis" means "the endothermic gasification of waste materials using external energy." (40 C.F.R. §60.51c) Typically, in commercial pyrolysis operations, waste material is loaded into a pyrolysis furnace or chamber, and there is generally some small amount of air (oxygen) present in the furnace. There can be several reasons for the presence of the air in the furnace. Some air may enter the furnace during the loading of the waste in the furnace chamber as the door to the chamber is opened and closed. Also, some air may be entrained within the waste. Further, the pyrolysis furnace may be operated at a slight negative pressure resulting in a small amount of air being drawn into the furnace through deficient seals. Thus, the term, "pyrolysis", is commonly used in the industry and used herein to encompass processes, wherein the atmosphere in the pyrolysis furnace may at times contain a very small amount of air (oxygen) during the pyrolysis reaction, but the amount is so small as to preclude the presence of visible combustion.

For industrial applications, the pyrolysis of the waste materials is typically a first step in the overall destruction of the materials. The pyrolysis process volatilizes or gasifies the organic compounds found in the waste and produces exhaust gases containing volatile organic compounds. In a second step, a burner unit combusts or oxidizes the volatile organic compounds.

Pyrolysis furnaces should not be confused with incinerators that operate in a starved-air mode. Such incinerators typically include primary and secondary combustion chambers. In the incineration process, a burner or other ignition source produces an open flame in the primary chamber. Combustion air is supplied to the primary chamber at a rate which is less than the stoichiometric amount of oxygen required to achieve complete combustion of the volatile organic compounds evolved from the thermal decomposition of the organic waste materials. Then, in the secondary combustion chamber, excess combustion air is supplied to completely decompose and oxidize the waste exhaust gases. Lewis, U.S. Pat. Nos. 4,474,121 and 4,517,906 disclose methods and apparatus for controlling the addition of an auxiliary fuel to a two-stage combustion furnace system which is operated in a starved-air mode in the first stage and in an excess air mode in the second stage. One problem with such starved-air incinerators is that the open flame in the primary combustion chamber produces turbulence and causes the suspension of particles in the exhaust gas stream. The particulate passes through the secondary combustion chamber and is emitted as pollutants, unless additional pollution control systems (e.g., scrubbers) are employed. It is expensive to install such air pollution control systems on incinerators, but such systems are often necessary to meet emission standards.

As discussed above, pyrolysis processes for destroying waste materials are generally known in the industry. For example, Hansen et al., U.S. Pat. No. 5,868,085 discloses a waste treatment unit having: a main frame; an input stage through which the waste material to be treated is introduced through an arrangement of valves that can be controlled to prevent unwanted incorporation of air or oxygen into the pyrolytic process; and a pyrolytic assembly comprising a thermally-insulated outer housing coaxially surrounding an ellipsoidally-shaped pyrolytic chamber. A rotatable screw conveys waste through the retort as the pyrolysis reaction takes place. A heating chamber is defined as the space between the outer housing and the retort. Fuel gases are combusted within the heating chamber to provide a source of heat energy for the pyrolysis. According to the '085 Patent, the gases liberated from the feed material during pyrolysis are processed to draw off pollutants contained therein by a combination of condensation and thermal oxidation. The gases are then either vented to the atmosphere or routed to supply energy, such as to a steam generator.

Keough, U.S. Pat. No. 4,648,328 discloses an apparatus and process for the pyrolysis of used vehicular tires. The apparatus includes a reaction chamber. According to the '328 Patent, tire fragments are introduced into and removed from the reaction chamber through airlock mechanisms to prevent the ingress of ambient air as the fragments are conveyed through the chamber by a chain and flight conveyor. The process includes shredding the used tires, preheating the tire fragments, passing the fragments through the reaction chamber, separating solid and gaseous products, and recycling a portion of the gaseous product to the heating means.

Also, incinerator processes, which introduce a flame into the incinerator chamber to burn the waste, are known. Brookes, U.S. Pat. No. 4,603,644 discloses an incinerator having a receiving chamber with an opening (vent) in a rear wall. An ignition chamber is supplied with fuel and air and fires a flame down onto the biomass placed in the chamber. The opening in the receiving chamber leads to an afterburner chamber having a burner member which bums the volatile constituents in the gases from the receiving chamber. The afterburner chamber transfers the heat to ducts which occupy the space under the receiving chamber, a heat transfer chamber.

One problem with the foregoing processes is that firing the burner in the chamber can cause instability and turbulence leading to the emission of particulate and ash material. These materials may be emitted from the system as pollutants. Accordingly, there is a need for a pyrolysis process, wherein a flame is not introduced in the pyrolysis chamber to thermally decompose the waste. One object of the present invention is to provide such a pyrolysis process.

In addition, Brookes, U.S. Pat. No. 5,611,289 discloses a gasifier for gasifying biomass waste. The gasifier comprises a primary chamber for receiving the waste, a fume transfer vent, and a mixing chamber to accept the pyrolysis gases from the primary chamber. The fumes then flow to an afterburner chamber, where a burning flame oxidizes the constituents of the fumes. According to the '289 Patent, a partitioning wall is disposed between the flame chamber and the primary chamber so as to preclude the heating flame from entering the chamber. A heat transfer chamber accepts the fully oxidized fumes, and heat from the fumes causes the heat transfer chamber to be heated. The primary chamber has a heat conductive floor and is superimposed on the heat transfer chamber. The heat from the heat transfer chamber rises through the floor to heat the primary chamber and biomass waste.

However, one disadvantage with the foregoing, conventional pyrolysis process is that transferring heat through the floor of the primary chamber is a relatively slow process. Thus, there is generally a long time period required for raising the temperature in the primary chamber and completing the pyrolysis reaction. This time-consuming process can be costly and inefficient.

Another disadvantage with the above-described conventional pyrolysis process is that depending upon the type of waste, it may not be possible to reach the required temperature in the primary chamber even if heat is applied through the floor for a long period of time. To overcome this limitation, the door to the primary chamber has a small air inlet allowing a small amount of air to enter the chamber. The introduction of air raises the temperature of the chamber by means of combustion of the waste material. Once combustion occurs, the process becomes exothermic and is no longer a pyrolysis process.

Further, the afterburner chamber is always in fluid communication with the heat transfer chamber and the hot gases always pass through the heat transfer chamber without control. Thus, heat is continuously transferred into the primary chamber so long as the auxiliary heat input burner in the afterburner chamber is burning. This results in two potential problems: 1) volatile organic compounds can be produced in the primary chamber before the afterburner chamber has reached the proper operating temperature resulting in incomplete combustion and emissions; and 2) highly volatile waste may evolve volatile organic compounds at such a high rate that the primary chamber will exceed acceptable temperatures, thus driving the volatilization rate ever faster to excess temperature limits and excess emissions.

In view of the foregoing problems with conventional pyrolysis processes, there is a need for a system, wherein the transfer of hot gases from the oxidation chamber to the pyrolysis chamber can be conducted in a controlled manner. If desired, the hot gases should be capable of being transferred to the pyrolysis chamber rapidly to heat the waste materials. One object of the present invention is to provide such a pyrolysis process. These and other objects, features, and advantages of the present invention are evident from the following description and figures.

SUMMARY OF THE INVENTION

The present invention relates to a process for the pyrolysis of waste material, particularly medical waste. In general, the process comprises the following steps. The waste material is placed in a sealed pyrolysis container, and the container is inserted into a load chamber. The discharge port of the container is connected to a pyrolysis gas transfer duct so that the container is in fluid communication with an oxidation chamber. The discharge port should be connected to the pyrolysis gas transfer duct by a mechanical locking means to form a substantially air-tight seal.

The load chamber holding the pyrolysis container is heated so that heat is transferred into the container causing the waste materials to decompose and produce pyrolysis gases comprising volatile organic compounds. The pyrolysis gases flow from the pyrolysis container, through the pyrolysis gas transfer duct, and into the oxidation chamber. The pyrolysis gas transfer duct may contain an air inlet port for maintaining the pyrolysis container at a negative pressure and adding air flow for initial pyrolysis gas combustion at the inlet to the oxidation chamber.

The oxidation chamber includes a burner unit and at least one air inlet port for controlling air flow into the oxidation chamber. The burner unit is located in the upper portion of the oxidation chamber and produces a flame for preheating the oxidation chamber and maintaining the required temperature for combustion of the pyrolysis gases. The oxidation chamber typically comprises multiple air inlet ports. Particularly, the oxidation chamber may contain tangential air inlet ports for directing air tangentially into the chamber, and radial air inlet ports for directing air radially into the chamber. In the oxidation chamber, the pyrolysis gases are combusted and heat is produced. At least a portion of the heat produced in the oxidation chamber is directed through a hot gas transfer duct, and into the load chamber.

The hot gas transfer duct contains at least one hot gas control damper. A microprocessor may be used to control the hot gas control damper and regulate the amount of heat directed to the load chamber. The microprocessor may use an algorithm including a time/temperature profile, combustion air input rate, and burner input rate to determine the endpoint of the process.

Different pyrolysis containers may be used. In one embodiment, the container has an integrated structure comprising four sidewall panels, a base panel, a cover, and a discharge port. The container may be made from a high temperature-resistant metal alloy and include a high temperature-resistant gasket for sealing the cover. The container may be introduced into the load chamber by means of transport guide rails. In another embodiment, the pyrolysis container includes a rectangular-shaped recessed portion, wherein the recessed portion extends upwardly from the base panel to provide a core heating surface. Various other sealed pyrolysis containers having different geometries and designs may be used in accordance with this invention.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description taken in connection with the accompanying drawings in which:

DETAILED DESCRIPTION OF THE PREFERRED EMBODIMENTS

The present invention relates to a process for the pyrolysis of waste materials particularly medical waste.

Figure 1:
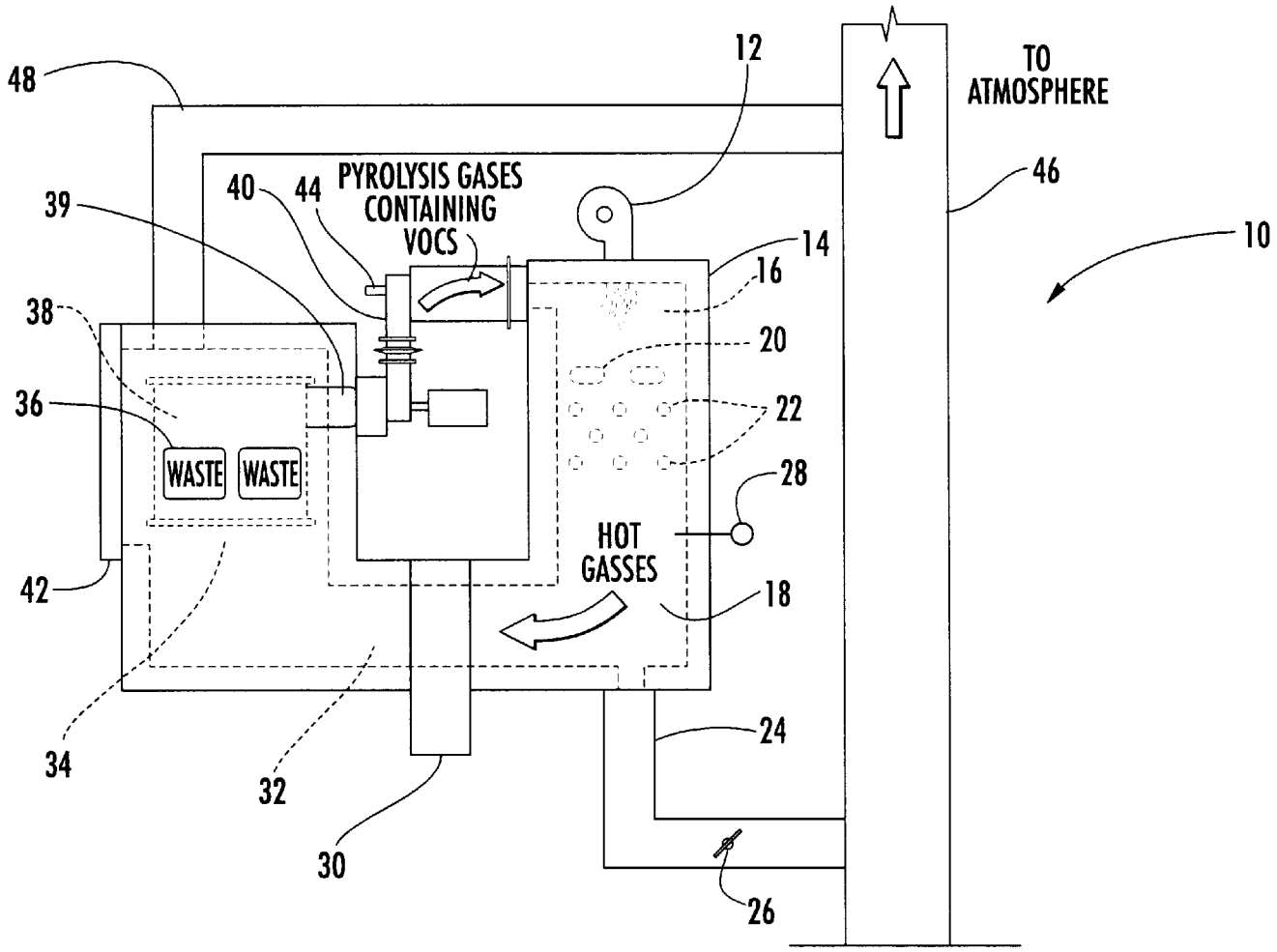
FIG. 1 is a schematic diagram showing one embodiment of the pyrolysis process of the present invention.

Referring to FIG. 1, a schematic illustration of the pyrolysis process of the present invention is generally illustrated. The entire system used to perform the destruction of the waste materials can be referred to as a pyrolysis unit and is generally indicated at 10 in FIG. 1. In practice, the pyrolysis unit 10 can be first purged with air. Then, a burner unit 12 located in an oxidation chamber 14 can be ignited to produce a heating flame. A vertically disposed oxidation chamber 14 having an upper portion 16 and a lower portion 18 is shown. The burner unit 12 is situated in the upper portion 16 of the oxidation chamber 14 so that the flame is projected downwardly. The fuel source of the burner unit 12 is typically an industrial fuel such as propane gas or natural gas. Air (oxygen) is supplied to the burner unit 12 to support combustion of the fuel. Typically, ambient air is used to supply the oxygen, but any material containing a sufficient amount of oxygen can be used such as oxygen-enriched air. In one embodiment, preheated air generated from the heat of the pyrolysis process can be used to support combustion of the fuel.

Figure 2:
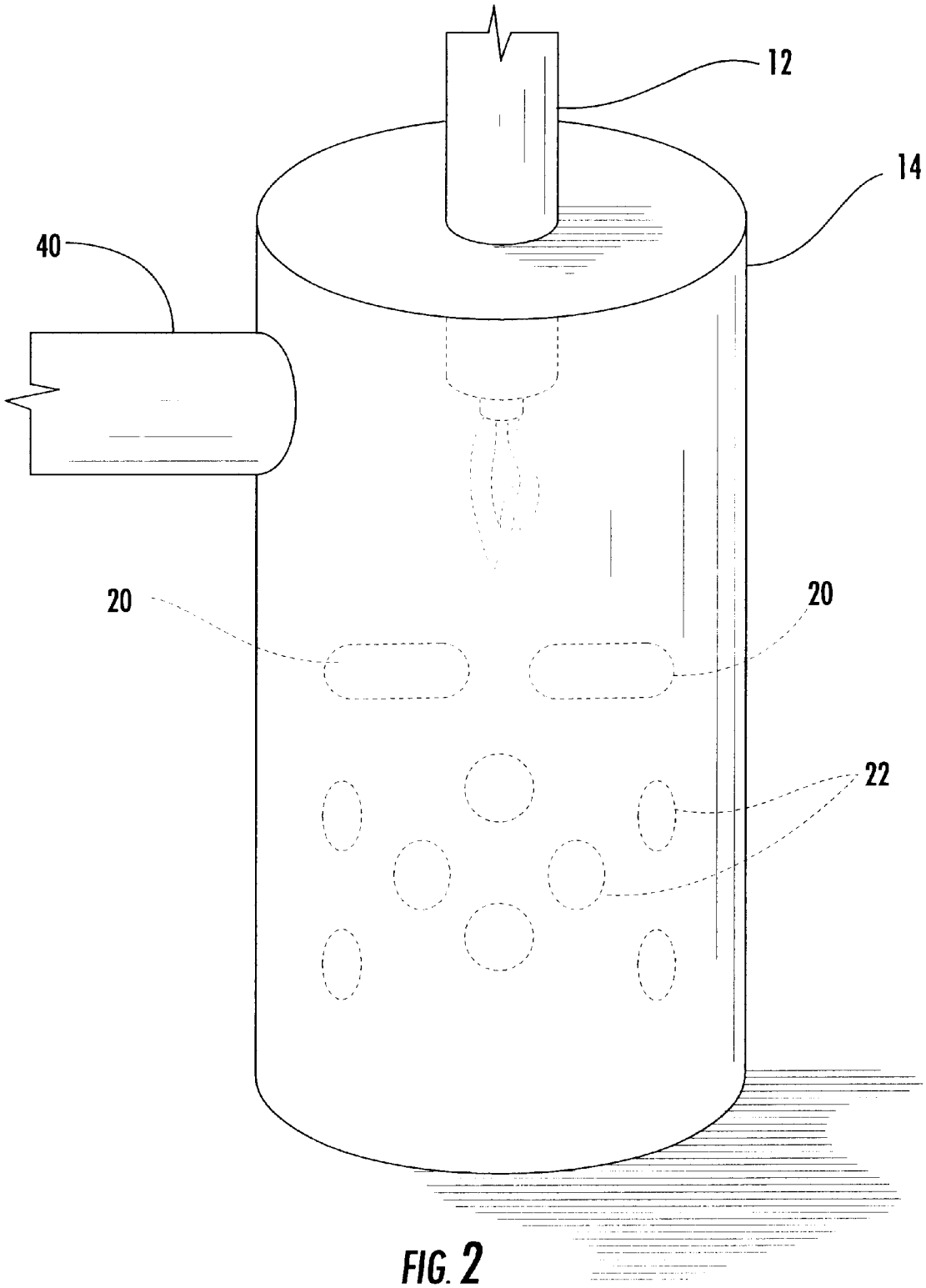
FIG. 2 is a close-up perspective view of the oxidation chamber shown in FIG. 1.

The combustion air for pyrolysis gas destruction is supplied to the oxidation chamber 14 by means of at least one air inlet port. In a preferred embodiment, the oxidation chamber includes multiple air inlet ports 20 and 22 having the structures shown in FIG. 2. Tangential air inlet ports 20 direct the air tangentially into the oxidation chamber, and radial air inlet ports 22 direct the air radially into the oxidation chamber. It has been found that air inlet ports having these designs are particularly advantageous, because the tangential air initiates combustion and protects the walls of the chamber in an area that can have the highest flame temperatures, and the radial air creates turbulent mixing that promotes good combustion without use of physical baffles in the chamber.

Referring back to FIG. 1, the hot gases initially generated in the oxidation chamber 14 by the combustion of the fuel and oxygen are vented to the atmosphere through an exhaust by-pass duct 24 containing a by-pass damper 26. The temperature of the hot exhaust gases in the oxidation chamber 14 is measured by a temperature sensing element 28. The temperature sensing element 28 is positioned so that it will measure the temperature of the hot exhaust gases at a point when the gases have been retained in the oxidation chamber 14 for the required time for efficient combustion. When the exhaust gases reach a pre-set temperature, a main hot gas control damper 30 in a hot gas transfer duct 32 starts to open and the by-pass damper 26 in the by-pass exhaust duct 24 starts to close. The opening of the main damper 30 diverts the hot gases to the hot gas transfer duct 32, thereby allowing the hot gases to be transported from the oxidation chamber 14 to a load chamber 34.

In this manner, the temperature within the load chamber 34 is controlled by the balance of hot gas flow between the load chamber 34 and the by-pass exhaust duct 24. The hot gas flow is adjusted by the relationship of the positions of the main damper 30 and by-pass damper 26.

The waste materials 36, to be destroyed in the pyrolysis process, are placed in a sealed pyrolysis container 38 having a discharge connector port 39. By the term, "waste material", as used herein, it is meant any suitable product that can be subjected to the pyrolysis process including, but not limited to, controlled substances, pharmaceutical products, animal carcasses, chemicals, toxic substances, hazardous substances, biological agents, and medical waste. The process of the present invention is particularly suitable for destroying medical waste which includes, for example, biological cultures, human pathological tissue and organs, blood-borne products, vials, intravenous bags, needles, syringes, scalpel blades, sutures, swabs, bandages, dressings, and other hospital and infectious waste. The structure of the pyrolysis container 38 is described in further detail below.

As shown in FIG. 1, the sealed pyrolysis container 38 is inserted into the load chamber 34. The pyrolysis container 38 may be inserted into the load chamber 34 by means of transport guide rails (not shown). A discharge connector port 39 is connected to a pyrolysis gas transfer duct 40 which leads to the oxidation chamber 14. In this manner, the pyrolysis container 38 is placed in fluid communication with the oxidation chamber 14. The pyrolysis container 38 is connected to the pyrolysis gas transfer duct 40 using any suitable mechanical fastening means. For example, the pyrolysis container 38 may be connected by a locking rod means. This locking mechanism exerts sufficient force to keep the pyrolysis container 38 and pyrolysis gas transfer duct 40 tightly connected to each other, thereby creating a substantially air-tight seal that is resistant to high temperatures. After the pyrolysis container. 38 has been placed in the load chamber 34, the door 42 of the load chamber 34 is closed, thereby creating a tight seal that is resistant to high temperatures.

As described above, the heat and hot gases produced in the oxidation chamber 14 flow through the hot gas transfer duct 32 and enter the load chamber 34 so that high intensity heat is transferred into the waste materials 36 in the pyrolysis container 38, and the waste materials 36 are thermally decomposed and transformed. Typically, pyrolysis of the waste materials begins at a temperature of about 450° F. At this temperature, the more volatile components of the waste start to gasify. In many instances, heat is continuously applied until the internal temperature of the pyrolysis container 38 is in the range of about 800° F. to about 1600° F., so that all of the organic components in the waste are gasified. The load chamber 34, which holds the pyrolysis container 38, is typically heated to a temperature in the range of about 1000° F. to about 1800° F. and held at a temperature necessary to ensure attainment of the desired temperature within the pyrolysis container 38. After the hot gases in load chamber 34 have transferred heat into the pyrolysis container 38, they are vented through load chamber exhaust duct 48.

The pyrolysis gases produced in the pyrolysis container 38 contain volatile organic compounds and are vented through the pyrolysis gas transfer duct 40 to the oxidation chamber 14. The pyrolysis gas transfer duct 40 includes an air inlet port 44, where air is injected to cause a slight negative pressure in the transfer duct 40 by a venturi effect. This negative pressure helps prevent leakage of the pyrolysis gases from the pyrolysis container 38. The pyrolysis gases containing the volatile organic compounds enter the oxidation chamber 14, wherein the pyrolysis gases are combusted and the volatile organic compounds are substantially oxidized. The pyrolysis unit further includes an atmosphere exhaust vent 46 for venting the oxidized pyrolysis gases and hot gases into the atmosphere.

In one embodiment of the present invention, the pyrolysis unit 10 comprises multiple load chambers 34. A pyrolysis container 38 holding waste material, as described above, is introduced into each load chamber 34. Each pyrolysis container 38 is connected via a separate pyrolysis gas transfer duct 40 into a single oxidation chamber 14. In this manner, multiple load chambers 34 can be integrated with one oxidation chamber 14, and an efficient process can be maintained.

Conventional microprocessor controllers are used to program the process steps and issue the appropriate commands. More particularly, a microprocessor monitors the temperature and draft at several locations in the pyrolysis unit 10 and uses the data from sensors to adjust the amount of fuel being fed to the burner 12; the combustion air introduced into the oxidization chamber 14; the hot gas flow rate directed to the load chamber 34; the hot gas flow rate diverted to the by-pass exhaust duct 24, and the negative draft pressure that moves the gases through the process. When the programmed sequence has been completed, the microprocessor switches the unit to a cool down mode by shutting down the burner 12 and directing cool air into the load chamber 34. The microprocessor controls the energy balance in the system to prevent an uncontrolled thermal event from occurring in the oxidation chamber 14. Further, the microprocessor controls an interlocking mechanism that prevents the door 42 to the load chamber 34 from being opened before the chamber 34 has been cooled to a pre-set temperature.

Figure 3:
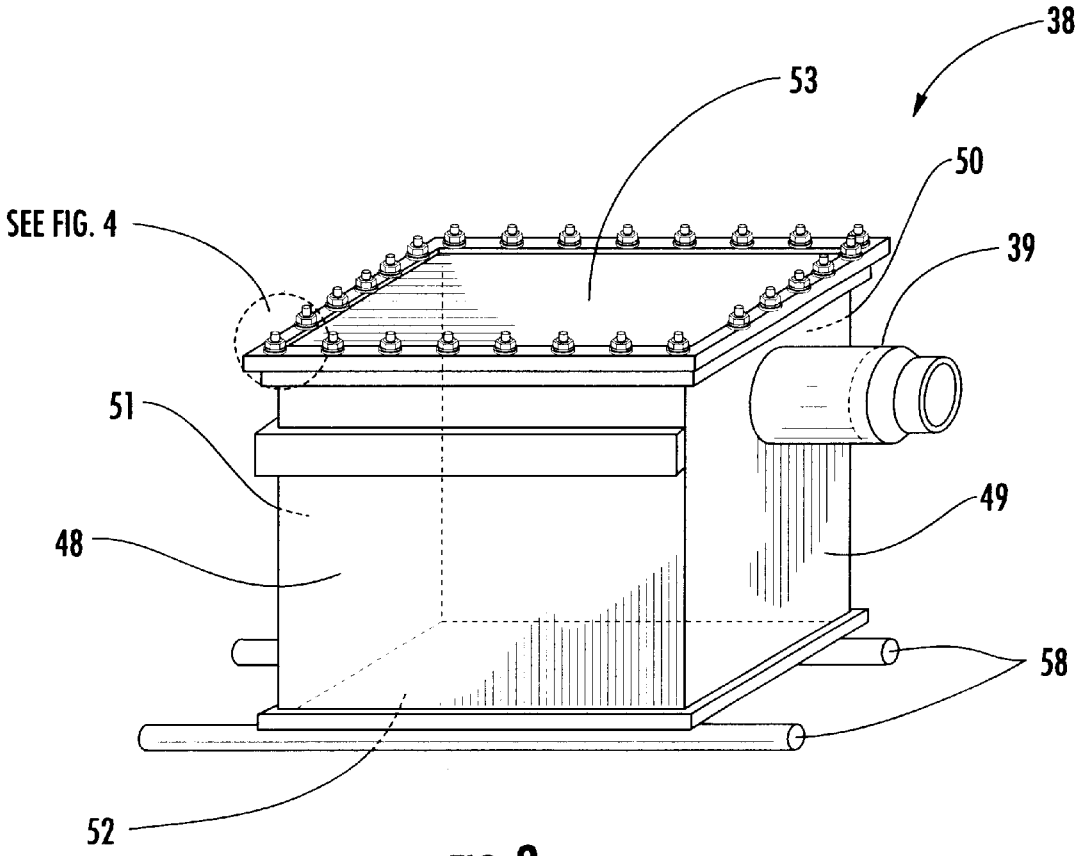
FIG. 3 is a perspective view of one embodiment of a sealed pyrolysis container for use in accordance with the pyrolysis process of the present invention.

Referring to FIG. 3, the pyrolysis container 38 is shown in more detail. The pyrolysis container 38 has a box-like structure including four sidewall panels 48, 49, 50, and 51; a bottom panel 52; and a removable cover (lid) 53. The pyrolysis container 38 can be fabricated using any suitable high temperature resistant material such as a metal or ceramic. The material is thermally-conductive so that heat can be transferred to the interior of the pyrolysis container 38. The pyrolysis container 38 has good mechanical strength so that it can hold a substantial amount of waste and be transported and handled easily.

Figure 4:
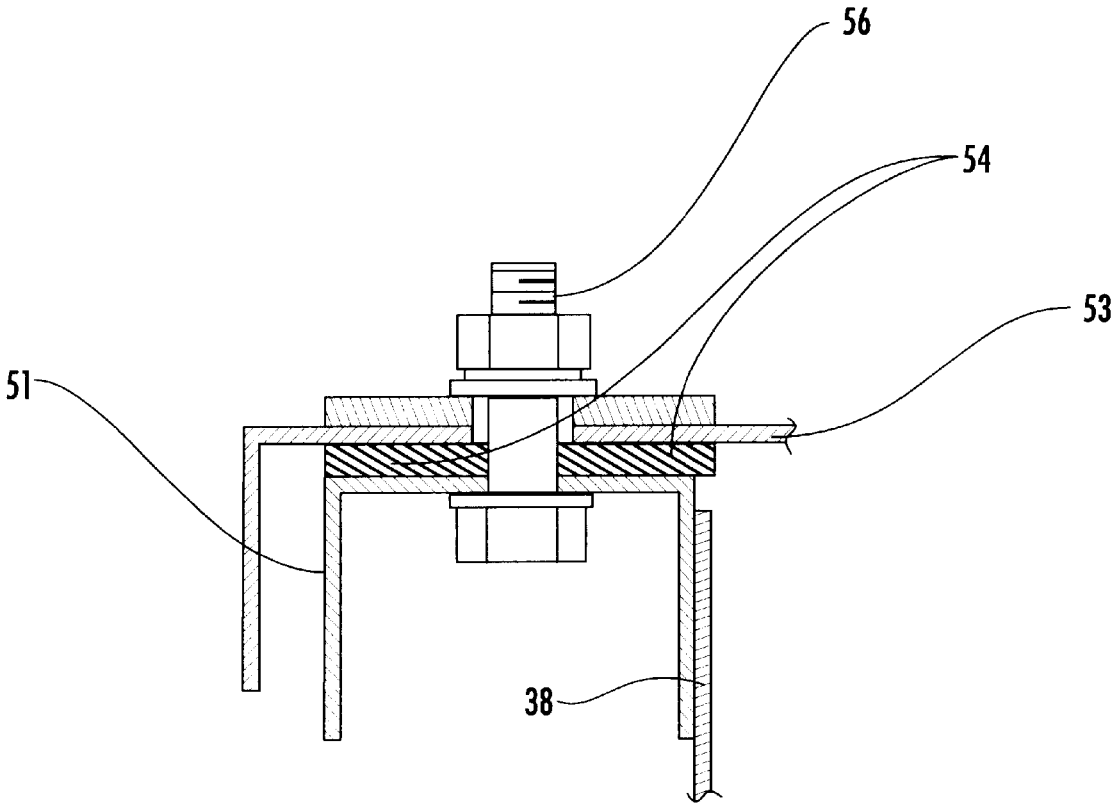
FIG. 4 is a close-up view of the lid region identified in FIG. 3 showing one embodiment of the lid closure mechanism of the present invention.

As shown in FIG. 4, after the waste material to be processed is loaded, a sealing gasket(s) 54 is installed and the lid 53 is attached using high temperature compression hardware 56 or other suitable fasteners, thus forming a substantially air-tight seal. Then, the sealed pyrolysis container 38 can be inserted into the load chamber 34 using transport guide rails 58 (FIG. 3). As the pyrolysis container 38 is inserted into the load chamber 34, the discharge connector port 39 engages and locks with the pyrolysis gas transfer duct 40 (FIG. 1). This locking mechanism holds the pyrolysis container 38 in place and creates a tight seal between the container and pyrolysis gas transfer duct 40. In this manner, the pyrolysis container 38 is placed in direct fluid communication with the oxidation chamber 14.

Figure 5:
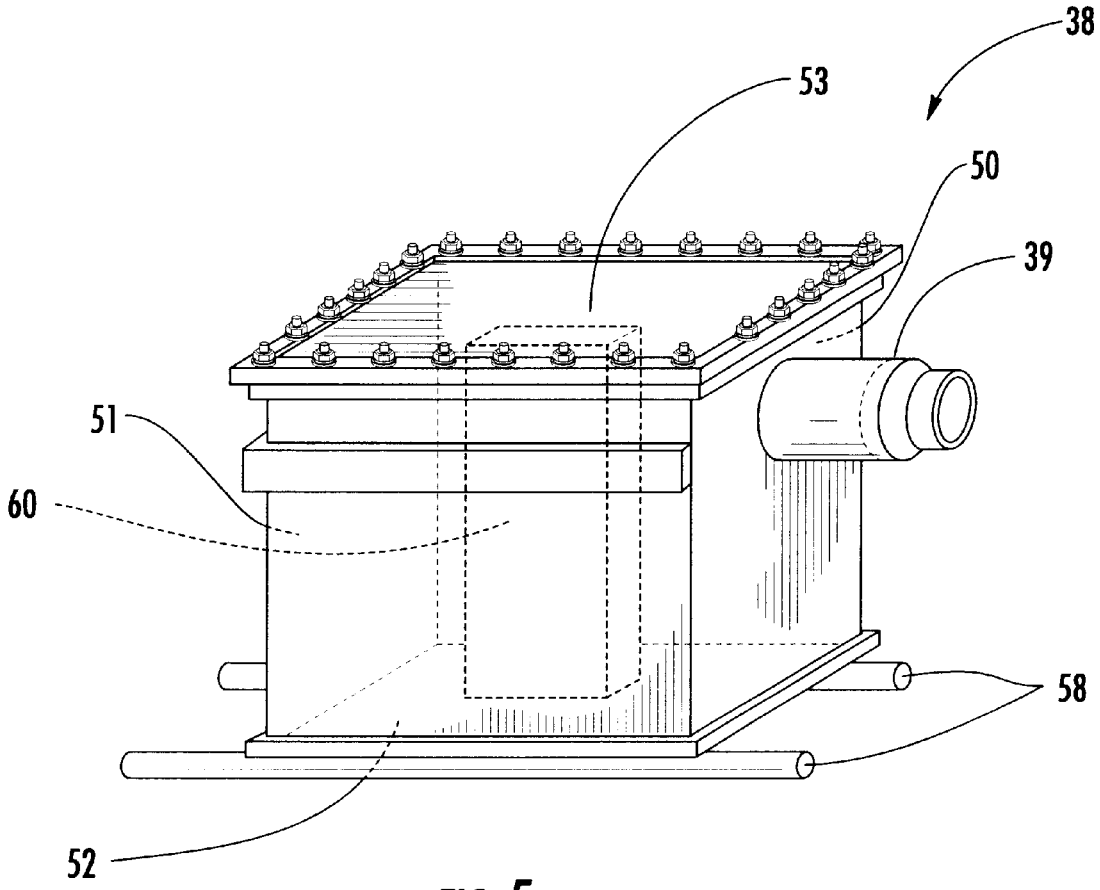
FIG. 5 is a perspective view of another embodiment of a sealed pyrolysis container for use in accordance with the pyrolysis process of the present invention.

The pyrolysis container 38 may have a box-like structure as shown in FIG. 5. In this embodiment, the bottom panel 52 of the container 38 includes a rectangular-shaped recessed portion 60. This concave area 60 extends upwardly from the bottom panel 52 to provide a core heating surface. This channel-like portion 60 increases the amount of surface area of the container 38, allowing more heat to be transferred into the container 38. In accordance with the present invention, the pyrolysis container may have other geometries and designs to further enhance heat transfer performance or improve the placement of specific waste types. In addition, other heat conductive elements, such as conductive rods or high temperature heat pipes, may be connected to the outside walls and project into the pyrolysis container space to improve the heat transfer rate to areas within the load.

The placing of the waste material in the pyrolysis container and inserting of the container in the load chamber provides several advantages over conventional systems as discussed above, wherein the waste is placed directly in a pyrolysis furnace or chamber. These advantages include, but are not limited to, the following: (1) all surfaces of the pyrolysis container are exposed to the hot gases; (2) air leakage into the pyrolysis container is controlled; (3) the hot pyrolysis container can be quickly removed by mechanical means and replaced with a new pyrolysis container holding the waste materials to be destroyed, thereby maintaining a hot load chamber, conserving fuel which would have been consumed while heating the load chamber, and greatly increasing efficiency of the pyrolysis process; and (4) the residue produced from the pyrolysis process is contained for easy handling to a disposal point.

It is appreciated by those skilled in the art that various changes and modifications can be made to the description and illustrated embodiments herein without departing from the spirit of the present invention. All such modifications and changes are intended to be covered by the appended claims.

What is claimed is:

1. A process for the pyrolysis of waste material, comprising the steps of:

a) placing waste material in a sealed pyrolysis container, the container having a discharge port;

b) inserting the pyrolysis container into a load chamber and connecting the discharge port of the container to a pyrolysis gas transfer duct so that the container is in fluid communication with an oxidation chamber;

c) heating the load chamber so that heat is transferred into the pyrolysis container causing the waste material to decompose and produce pyrolysis gases comprising volatile organic compounds;

d) passing the pyrolysis gases from the pyrolysis container, through the pyrolysis gas transfer duct, and into the oxidation chamber, wherein the pyrolysis gases are combusted and heat is produced; and e) directing at least a portion of the heat produced in the oxidation chamber, through a hot gas transfer duct, and into the load chamber.

2. The process of claim 1, wherein the oxidation chamber comprises a burner unit and air inlet port for controlling air flow into the oxidation chamber.

3. The process of claim 1, wherein the hot gas transfer duct comprises at least one hot gas control damper.

4. The process of claim 1, wherein the discharge port of the pyrolysis container is connected to the pyrolysis gas transfer duct by a mechanical locking means to form a substantially air-tight seal.

5. The process of claim 1, wherein the pyrolysis gas transfer duct comprises an air inlet port for maintaining the pyrolysis container at a negative pressure and adding air flow for initial pyrolysis gas combustion at an inlet to the oxidation chamber.

6. The process of claim 1, wherein the load chamber is heated to a temperature in the range of about 1000° F. to about 1800° F.

7. The process of claim 1, wherein the oxidation chamber is a vertically arranged chamber having upper and lower portions.

8. The process of claim 7, wherein the burner unit is located in the upper portion of the oxidation chamber and produces a flame for preheating the oxidation chamber and maintaining the required temperature for combustion of the pyrolysis gases.

9. The process of claim 1, wherein the oxidation chamber comprises multiple air inlet ports.

10. The process of claim 9, wherein the oxidation chamber comprises tangential air inlet ports for directing air tangentially into the chamber.

11. The process of claim 9, wherein the oxidation chamber comprises radial air inlet ports for directing air radially into the chamber.

12. The process of claim 9, wherein the oxidation chamber comprises tangential and radial air inlet ports.

13. The process of claim 3, wherein a microprocessor controls the hot gas control damper and regulates the amount of heat directed to the load chamber.

14. The process of claim 13, wherein the microprocessor uses an algorithm including a time/temperature profile, combustion air input rate, and burner input rate to determine an endpoint of the process.

15. The process of claim 1, wherein the waste material is selected from the group consisting of controlled substances, pharmaceutical products, animal carcasses, chemicals, toxic substances, hazardous substances, biological agents, and medical waste.

16. A process for the pyrolysis of waste material, comprising the steps of:

a) providing a plurality of sealed pyrolysis containers, each container holding waste material and each container having a separate discharge port;

b) providing a plurality of load chambers, and inserting each pyrolysis container into a separate load chamber and connecting the discharge port of each container to a separate pyrolysis gas transfer duct for each container so that each container is in fluid communication with a single oxidation chamber;

c) heating each load chamber so that heat is transferred into each pyrolysis container causing the waste material to decompose and produce pyrolysis gases comprising volatile organic compounds;

d) passing the pyrolysis gases from each pyrolysis container, through each pyrolysis gas transfer duct, and into the single oxidation chamber, wherein the pyrolysis gases are combusted and heat is produced; and e) directing at least a portion of the heat produced in the oxidation chamber into each load chamber.

17. A process for the pyrolysis of waste material, comprising the steps of:

a) placing waste material in a sealed pyrolysis container, the container having an integrated structure comprising four sidewall panels, a base panel, a cover, and a discharge port;

b) inserting the pyrolysis container into a load chamber and connecting the discharge port of the container to a pyrolysis gas transfer duct so that the container is in fluid communication with an oxidation chamber;

c) heating the load chamber so that heat is transferred into the pyrolysis container causing the waste material to decompose and produce pyrolysis gases comprising volatile organic compounds;

d) passing the pyrolysis gases from the pyrolysis container, through the pyrolysis gas transfer duct, and into the oxidation chamber, wherein the pyrolysis gases are combusted and heat is produced; and e) directing at least a portion of the heat produced in the oxidation chamber, through a hot gas transfer duct, and into the load chamber.

18. The process of claim 17, wherein the container is made from a high temperature-resistant metal alloy or ceramic.

19. The process of claim 17, wherein the container further comprises a high temperature-resistant gasket for sealing the cover to the container.

20. The process of claim 17, wherein the pyrolysis container is inserted into the load chamber by means of transport guide rails.

21. The process of claim 17, wherein the container includes a rectangular-shaped recessed portion, the recessed portion extending upwardly from the base panel to provide a core heating surface.

* * * * *